US007648433B1

(12) United States Patent
Huqueriza

(10) Patent No.: US 7,648,433 B1
(45) Date of Patent: Jan. 19, 2010

(54) BALL THROWING AND CATCHING DEVICE

(76) Inventor: Esar S. Huqueriza, 2715 Georgia St., Vallejo, CA (US) 94951

( * ) Notice: Subject to any disclaimer, the term of this patent is extended or adjusted under 35 U.S.C. 154(b) by 0 days.

(21) Appl. No.: 12/286,482

(22) Filed: Sep. 29, 2008

(51) Int. Cl.
*A63B 59/02* (2006.01)
*A63B 65/12* (2006.01)

(52) U.S. Cl. ..... 473/510; 473/505

(58) Field of Classification Search ..... 473/513, 473/512, 505, 510; 273/342; D21/724
See application file for complete search history.

(56) References Cited

U.S. PATENT DOCUMENTS

| | | | | | |
|---|---|---|---|---|---|
| 734,752 | A | * | 7/1903 | Ring | 473/510 |
| 1,022,186 | A | * | 4/1912 | Engler | 473/509 |
| 1,570,632 | A | * | 1/1926 | Kideney | 473/511 |
| D83,254 | S | * | 2/1931 | Holm | D3/257 |
| 2,436,174 | A | * | 2/1948 | Myers | 473/569 |
| 2,510,403 | A | * | 6/1950 | Krupp | 473/509 |
| 3,115,129 | A | * | 12/1963 | Merriman | 124/5 |
| 3,392,978 | A | * | 7/1968 | Wiest, Jr. | 473/509 |
| 4,302,017 | A | * | 11/1981 | Huqueriza | 473/510 |
| D449,864 | S | * | 10/2001 | Forkert | D21/721 |

* cited by examiner

*Primary Examiner*—Gene Kim
*Assistant Examiner*—M Chambers
(74) *Attorney, Agent, or Firm*—William S. Bernheim

(57) ABSTRACT

A device for playing a ball game by hurling a ball against a wall and catching it on the rebound is described. The device comprises a hollow, cylindrical body member resembling an elongated capsule with the top half of the capsular diameter removed for approximately ⅔ of its length, forming thus an open topped channel section, the remainder forming a closed end base section the rounded end of which serves as the hand hold for using the device, the inner surface of the channel and base sections integrally defining a passageway for the ball when it is either thrown or caught by the device; a safety strap including means for its connection to the device and attachment to the player's wrist is also described.

10 Claims, 7 Drawing Sheets

BALL THROWING AND CATCHING DEVICE

BACKGROUND OF THE INVENTION

Field of Invention

This invention relates generally to a hand held ball handling device used by one or more players in a ball game. More particularly, the invention relates to an amusement device, by the use of which, skilled, as well as relatively unskilled persons can catch and hurl a ball either when playing alone or in competition between more than one player.

Various types of devices for throwing and catching a ball have been described in patent literature. One of such devices is shown in U.S. Pat. No. 3,392,978 wherein a ball is launched upwardly on a curved trajectory into the air by the device having an arcuate channel, the device including the tossing opening at one end and the receiving oval inlet at the other end with a handle affixed to the rear side of the device. U.S. Pat. No. 3,115,129 discloses a ball-throwing device comprising a cylindrical main body portion in combination with a hollow handle portion having a fixedly secured core therein. The inside of the main body portion is provided with projecting ribs which are adapted to cooperate with a ball having concentric grooves. U.S. Pat. No. 3,697,074 describes a large bowl-shaped ball launcher having a concave surface and a handle to be held by a player. A ball having very little bounce is thrown upwardly in the air and caught on the down slope of the launcher. U.S. Pat. No. 3,887,184 discloses a hand-held catch ball device having a support, a ball-launching ramp having side rails, a bucket-like receptacle positioned at one end and a handle attached to the opposite end of the device. Other devices employed to hurl a ball against a wall by one player and catch it by the opponent in the game known as Jai-Alai are likewise known in the art. Such devices are of curved configuration and include a handle with a strap means connected to the handle for securing a hand of a player to the body of the device. U.S. Pat. No. 5,290,039 presents with the general appearance of the basket and handle devices used in Jai-Alai, excepting that the described invention does not provide a safety strap; and, the manner of holding the device involves a handle designed in a triangular form to fit into the web space between the index and middle fingers with the hand splayed around the handle, much like the grip a baseball pitcher used on a ball he is preparing to hurl.

Problems related to these patents were the cost of creating some of the devices because of the complexity of the designs. Some designs suffered because they were not conducive to utilizing the ball hurling and catching device in playing a ball game on a conventional racquetball or handball court.

Devices having separate catching and throwing openings, such as was described in U.S. Pat. No. 3,392,978 were awkward in use and not conducive to use in more rapid games, especially where the game involved bouncing the ball off walls and or the floor between a throw and the next catch. The designs of all of the prior art patents included a device that had a ball throw/receive section that was affixed to a separate handle section. The design created a spatial disconnect between the immediacy of the player's hand/wrist control of the ball manipulating section itself. U.S. Pat. No. 4,302,017 remedied most of these concerns. The design was simple and the device could be made from readily available and inexpensive materials. The same opening was used for both throwing and catching the ball, and the device was designed such that base portion of the opening, situated at the end of the device where it is held by the player, conforms in shape and general size to the ball being used, thus affording some protection against the ball's being unintentionally displaced when the device was held upright or even when tilted almost to the horizontal. The device was hand held and allowed improved tactile sensation of the contact of the ball with the device, and it was compatible with use in racquetball courts where space limitations and the speed of the ball movement had created problems when using prior art devices. Unfortunately, even though U.S. Pat. No. 4,302,017 remedied most of problems found with the prior art, over time it became obvious that there were some design features that needed to be improved upon. If the player inattentively lost his or her grip on the holding section of the device, it could fly out of his hand and potentially injure someone in its path of release; there was a tendency for the ball to deflect and be missed if it was caught near the tip of the ball catching concavity, and the design of the lateral wall of the device allowed the ball to too readily roll out to the right or left when being caught or thrown.

OBJECTS OF THE INVENTION

Accordingly, it is a primary object of this invention to provide a ball catching and throwing device having enhanced safety features that practically prevents accidental loss of grip-control of the device, thus reducing the risk of injuries to other players and or bystanders.

It is another object to provide a device with improved ball catching and throwing characteristics.

Still another object is provide design features that allow less skilled users to play with less tendency to lose control and have the ball roll out of the device or fly out at less desirable tangents.

Another object is to allow for greater speed and ball control characteristics as skill in using the device is gained; the design provides that spin can be applied to the ball, creating differing bounce patterns than happen with prior art devices.

It is a further object to provide a device that supports the wrist of the holding hand and reduces the potential for wrist injury when using the device.

These and other objects and advantages will be apparent to those skilled in the art in light of the following disclosure, claims and accompanying drawings.

SUMMARY OF THE INVENTION

In accordance with the preferred embodiment of the present invention what is seen is a ball game device for hurling and catching a ball that comprises a hollow, relatively rigid, substantially cylindrical body member having one fully enclosed end that is designed to fit into the cupped palm and fingers of the human hand, the holding-cup portion of the device; the device continuing forward with the top half of the cylinder wall removed, presenting thus as an open faced arcuate form having a right and a left top plate that at its rearmost extreme blends into the forward edge of the holding-cup section and at its forward extreme terminates as a bottom half only version of the holding-cup; the inner surface of the forward projecting half cylinder defines a rolling-passageway for the ball when it is either caught in or hurled from the device by a player, and, the full cup of the hand held end serves to hold the ball when at rest; a wrist strap affixed to the holding-cup section provides wrist support for protection from injury as well as providing protection against accidental release of the device; a slight top-ridge projecting inward centrally around the periphery of the rolling-passageway section serves to afford better catching control of the ball, reduces the tendency of the ball to roll out when the device is at rest, and can be used by more expert players to apply top or bottom spin to the hurled ball in order to create differing bounce characteristics as the ball strikes a rebound surface.

DETAILED DESCRIPTION OF THE PREFERRED EMBODIMENT(S)

Figure 1:
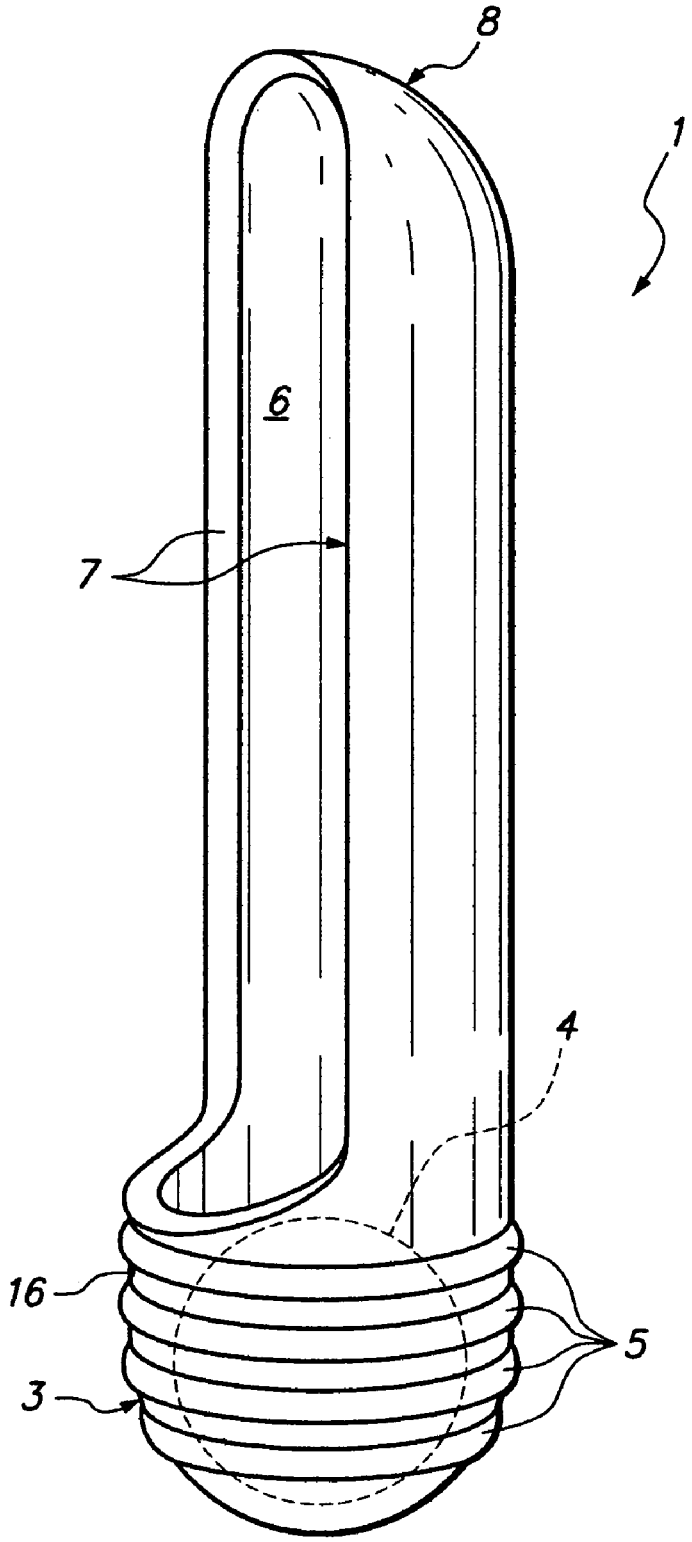
FIG. 1 is a perspective view of the device showing a ball placed in the interior thereof within its holding-cup end wall.

A ball game device ("Device") FIG. 1 of this invention is illustrated by three views in its upright position. The Device 1 comprises an integral, elongated cylindrical, capsule shaped body, that throughout the major portion of its length has the top half of the cylinder removed, that portion thus appearing as an arcuate, half cylinder shaped ball catching and receiving channel ("Body") 2 FIG. 1 that changes near its base end into a shorter full cylinder section that in turn is modified to form a hand-grip section ("Base") 3 FIG. 1 by its ending in a roughly bowl shaped configuration formed by arcs radiating from like-points situated at 180 degree separation around the perimeter of the cylinder with the arc apices situated over the longitudinal central axis of the full cylinder section.

The design of the Base 3 section obviates the necessity of having a separate handle affixed to the device as was shown in the prior art; and the internal concavity of the Base 3 also serves as a game ball ("Ball") 4 FIG. 1 holding device when the player is not actively engaged in the act of either catching or hurling the Ball 4; the internal form and diameter of the Base 3 corresponding approximately to the diameter of the Ball 4 utilized in conjunction with the Device 1, thereby preventing excessive lateral movement of the Ball 4 when it is situated within the confines of the Base 3 of the Device 1 in position to be projected therefrom.

The length of the Base 3 between the lower end of the Device 1 and the Base's 3 termination at its juncture with the Body 2 of the Device 1, is slightly greater than the diameter of the Ball 4, thus insuring that the Ball 4 will be prevented from unintentional displacement or falling out from the Device 1 when the Device 1 is held in an upright or even tilted to an almost horizontal position.

Figure 5:
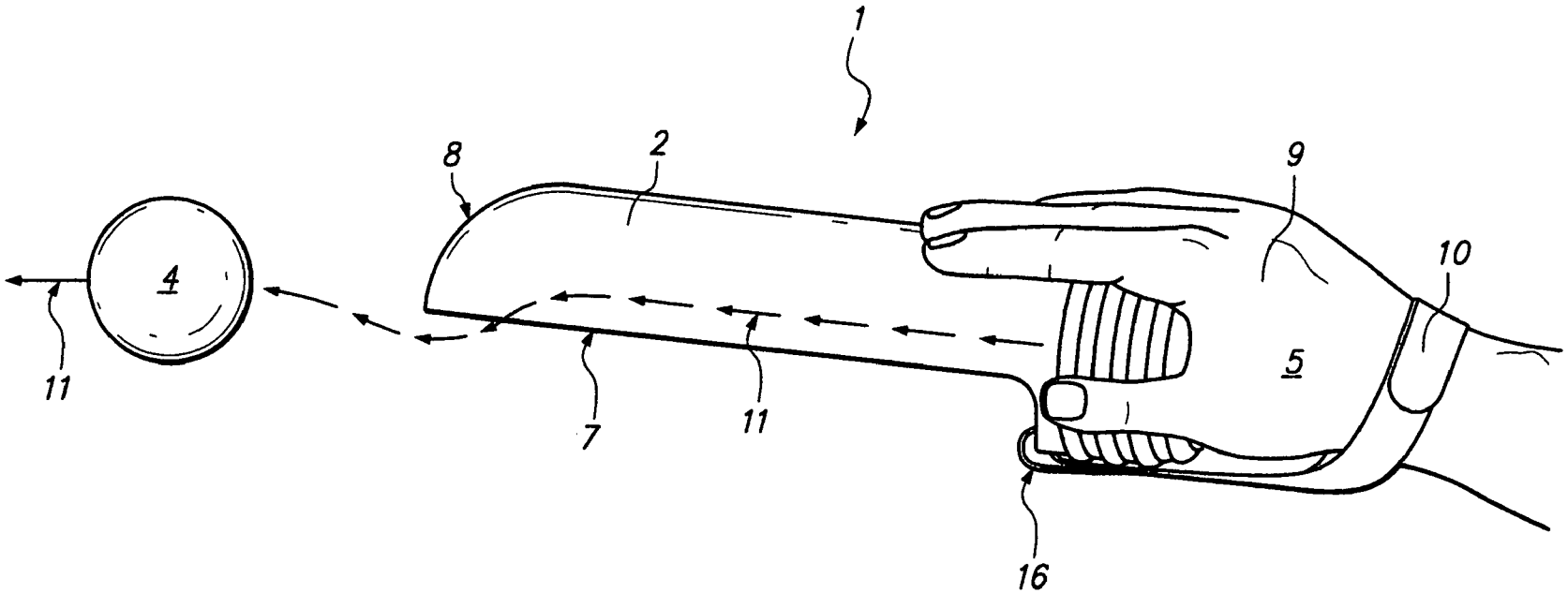
FIG. 5 is a pictorial view of the device held in the player's hand in the position for hurling a ball.

The Base 3 further presents with a series of full circumferential elevations 5 FIG. 1 that serve to reinforce the Base 3 and to provide added retentive capability where a hand 9 FIG. 5 of the player grips the Base 3 while the Device 1 is in use; ideally, additional grip support is provided by the elevations 5 being overlaid with a relatively thin band of a suitable non-slippery material, such as a fabric, canvas, rubber, leather or the like (not shown); such material may be secured adhesively or by any other suitable means to the outer surface of the Base 3.

The internal aspect of the Body 2 constituting a rolling Ball 4 passageway channel ("Channel") 6 FIG. 1 that serves as the Ball 4 receiving and throwing section of the Device 1; the inner surface of the Channel 6 is smooth throughout and communicates as the continuation of a straight line passageway from the internal aspect of the Base 3, defining thus a straight line passageway to an arcuate partial end wall ("Tip") 8 FIG. 1 for the Ball 4 when it is either hurled from or received into the Channel 6 of the Device 1.

The Tip 8 has been found to increase the effectiveness of the Device 1 in maintaining control of the Ball 4 over devices of the prior art, particularly when a Ball 4 is launched or caught at high speed.

Figure 4:
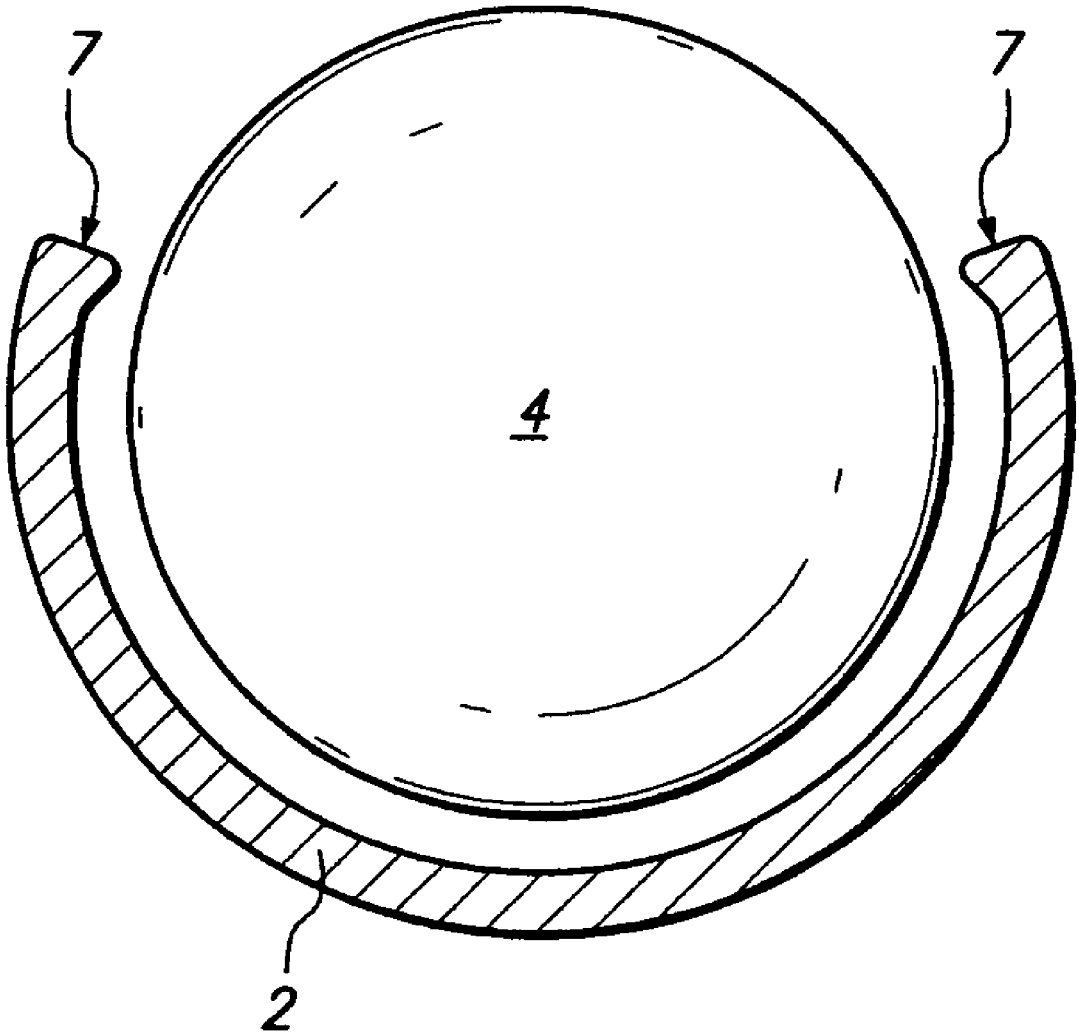
FIG. 4 is a transverse sectional view of a point midway in the length of the rolling-passageway section of the device showing the incurved upper portion of the side wall.

The topmost margin of the Channel 6, comprises a widened top-plate ("Lip") 6. FIG. 4 that serves to reinforce the anti-torsional stability of the Body 2, provides some improved catching and holding ability and allows the imparting of "spin" when launching the Ball 4 from the Device 1, all three features having been lacking in the prior art.

To appreciate the dimensions of the Device 1, the overall length of the Body 2 member may vary from about 6 in. (15.2 cm.) to about 15 in. (38.1 cm.), the preferred length being about 12 in. (30.5 cm.), its diameter at the Base 3 area level may vary from about 2 in. (5.1 cm.) to about 4 in. (10.2 cm.), respectively, the preferred diameter being about 2.5 in. (6.3 cm.). For best results in operating the Device 1 for throwing and catching a Ball 4, the overall length of the Body 2 member should be from about 3 to about 6 times greater than the diameter of the Ball 4.

As regards the inner diameter of the Base 3, it should be from about ¼ in. (0.64 cm.) to about 1 in. (2.54 cm.) greater than the diameter of the Ball 4 used with the Device 1 to insure that there is sufficient clearance for a free passage of the Ball 4 into and from the Channel 6 section without any hindrance; in the event that it is felt desirable to somewhat increase the friction between the Ball 4 and the internal Channel 6 wall, the inner surface of the Body 2 section may be covered with any suitable non-slippery fabric material thereby improving the spin of the Ball 4 and decreasing its slippage, especially during its launching.

A safety strap ("Strap") 10 FIG. 5 is detachably but securely attached around the player's wrist by Velcro closures or other such means; at its opposite end, the Strap 10 being permanently attached to the Base 3 at its top, forward most portion through a set of strap slots 16 FIG. 5, thus reducing the risk of injuries to other players and or bystanders caused by accidental loss of a player's grip on the Device 1; the Strap 10 also serves to support the wrist of the player's holding hand 9, thus reducing the potential for wrist injury when using the Device 1.

While, in the described preferred embodiment, the Device 1 is constructed of a substantially rigid, lightweight, durable molded plastic, other materials, such as wood, fiberboard, metal or combinations thereof are likewise suitable. In accord with the chosen material, the wall thickness of the Device 1 may need to be altered to insure adequate structural strength and durability.

The Ball 4 used in conjunction with the Device 1 should possess a good bounce and be able to spring back from a wall against which it has been thrown; a conventional, all-purpose rubber handball being entirely satisfactory.

Figure 6:
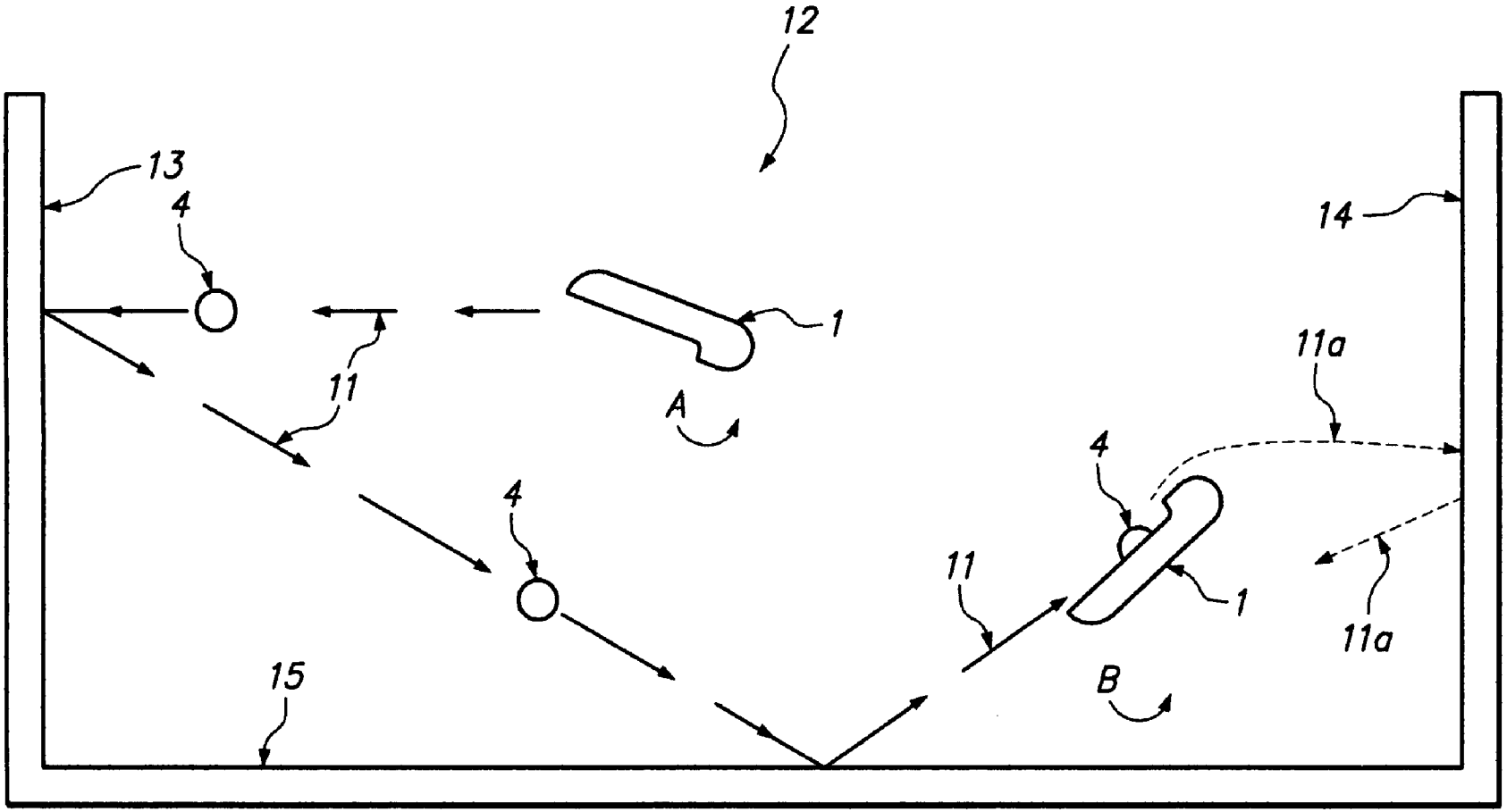
FIG. 6 is a diagrammatic view of a court and of a manner of playing the ball game by two persons.

The manner of handling the Device 1 of this invention can best be understood from consideration of the views shown in FIGS. 5 and 6. where Ball 4 having first been positioned inside the deepest portion of the well of the Base 3 of the Device 1, is held by a player's hand 9 in a substantially horizontal position but slightly inclined upwardly and forwardly to prevent the Ball 4 from rolling out inadvertently; following which the Ball 4 is ejected from the Device 1 toward the ball court end-wall ("Wall") 13 FIG. 6 by a rapid swinging type motion of the player's arm that sends the Ball 4 down the length of the Device 1 where it exits along the trajectory indicated by the broken line 17 FIG. 5.

A diagrammatic rendition of a ball playing court 12 FIG. 6, such as a standard handball court, shows a court having a pair of opposed end walls 13 FIG. 6, 14 FIG. 6, and a floor 15 FIG. 6. In one embodiment, the game is played by two players A FIG. 6 and B FIG. 6; the players A and B stand side by side, each player holding a Device 1. Player A hurls Ball 4 against a wall ("W one") 13 FIG. 6 along the trajectory 11. On the rebound off W one 13 the Ball 4 bounces on the floor 15 FIG. 6 and is caught by the Device 1 held by player B, who in turn hurls the Ball 4, directing it to the opposite end wall 14 FIG. 6 to make it rebound along the trajectory 11*a* and then be caught by player A, the game continues until one of the players A or B fails to catch the Ball 4 in the Device 1, or one player A or B achieves a predetermined number of points based on the opponent's repeated failure to catch the Ball 4.

It will be understood that the game may be played according to any other predetermined rules by 2, 3 or 4 persons. Likewise, one person can utilize the Device 1 and Ball 4 for practice purposes; or two or more persons can play using two side walls, a single end wall and the floor, etc.

It is to be noted that the arcuate partial end wall 8 configuration of the Device 1 may be modified by providing it with a straight end portion (not illustrated) and/or a tapered open end having a lower arcuate end height than in the embodiment described prior (not illustrated).

Because of the novel design features of the Device 1, such as the in turned Channel-Lip 7, and the improved grip enhancement afforded by the Elevations 5 on the Base 3 as well as by the presence of the Strap 16 it is relatively easy for an unskilled person to safely throw and catch a Ball 4 in any of the several manners described prior. While catching the Ball 4 requires some skill and dexterity, it may be learned in a relatively short period of time depending on the ability and coordination of the individual.

Figure 7A:
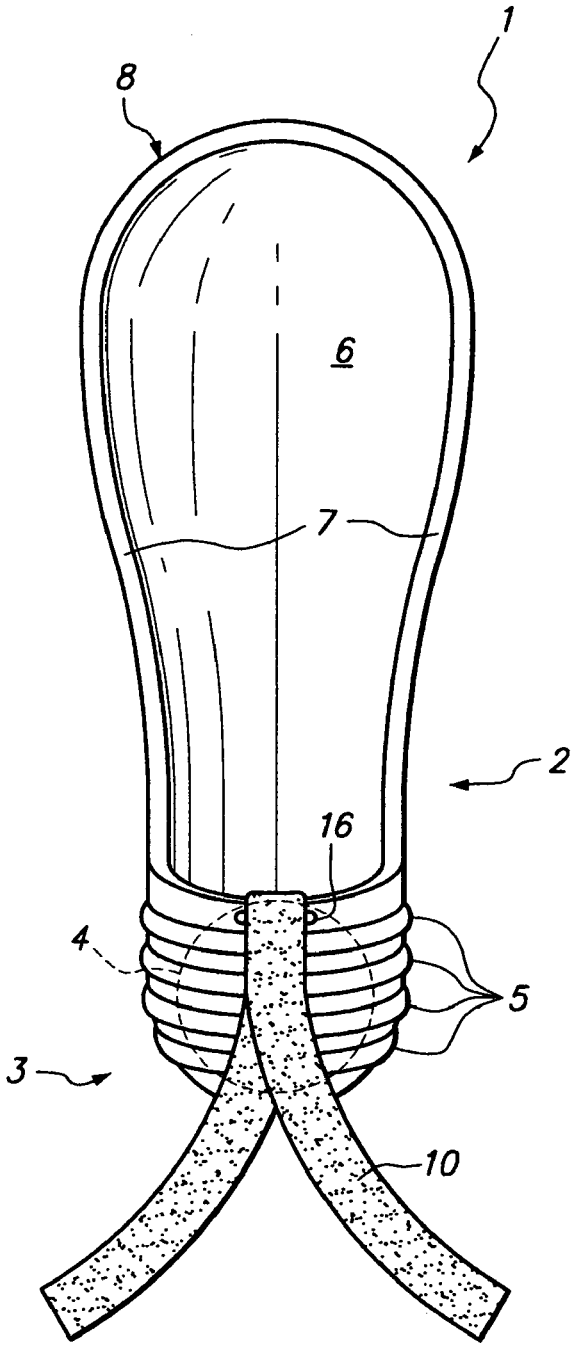
FIG. 7 presents a front view (7*a*) and a side view (7*b*) of a second embodiment, one designed for use in single walled space or other unenclosed play spaces.

As shown in FIG. 7 a special embodiment, designed for use in a single walled space where there is no opposed wall, or even in an open space play area, involves modification of said Body section 2 as follows: viewed from the front in FIG. 7*a*, looking down into the open face of the concave aspect of said Channel 6, said Lip 7, instead of continuing forward as a continuous, even extension of the width of said Base 3, expands evenly bilaterally to reach a maximum width at a point slightly greater than a Ball's width 4 from said Tip 8 of said Body 2; the actual point of greatest width being located at a point from said Tip 8 that is slightly greater than the diameter of said Ball 4 being used; after which said Body 2 comes to an arcuate Tip 7 as in the prior embodiment 7 FIG. 2. A Safety strap 10 is seen depending from said strap attachment 16 at the forward topmost end of said Base 3.

Figure 2:
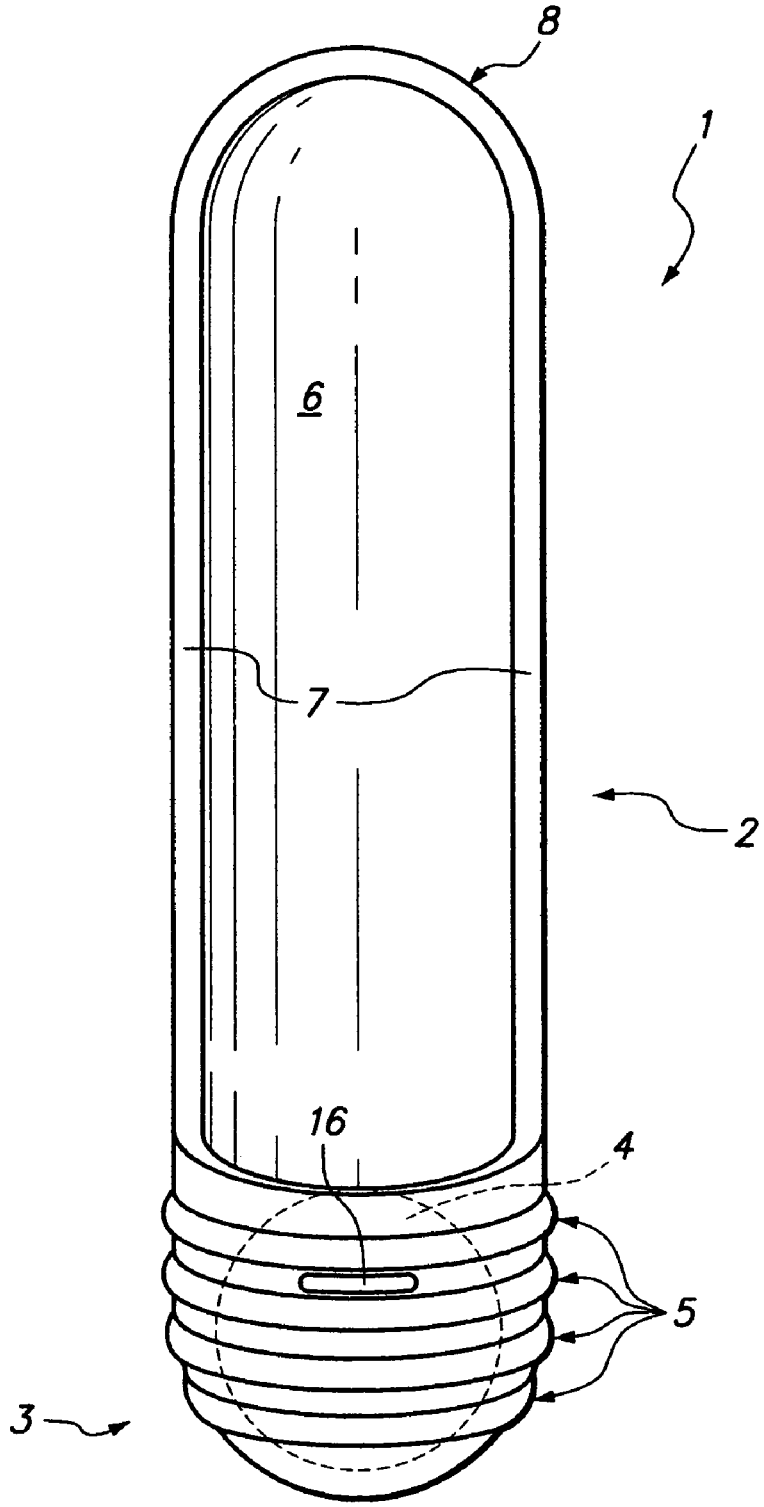
FIG. 2 is a front elevational view of the device.
Figure 3:
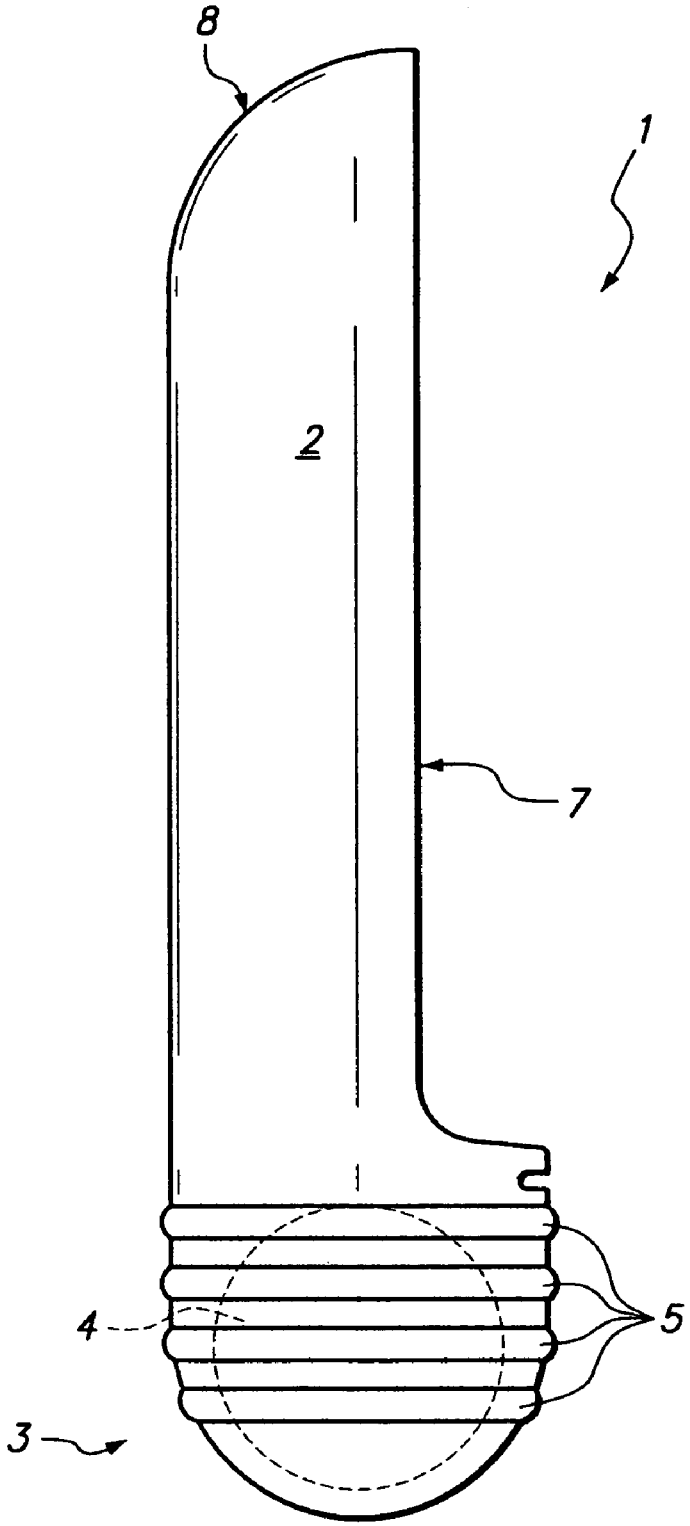
FIG. 3 is a side elevation cross-sectional view of the device.
Figure 7B:
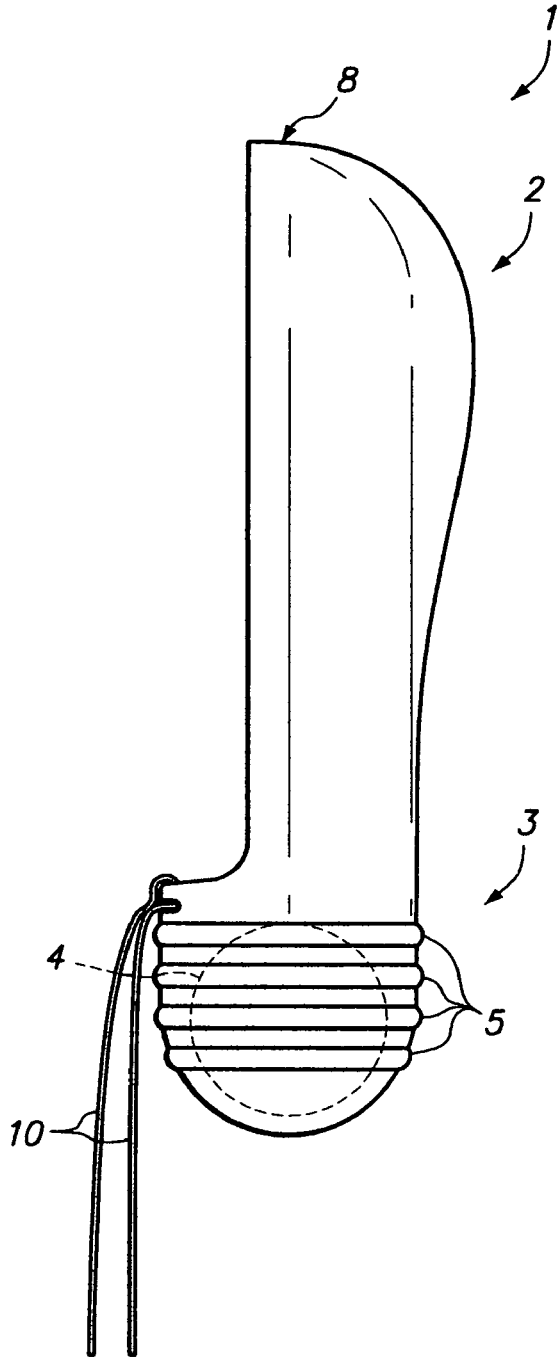

Seen from the side view FIG. 7*b*, instead of continuing forward as a continuous even extension of the width of said Base 3 as shown in FIG. 3, said Body 4 diverges in an even, arcuate manner from the horizontal line of said Channel's 6 said top plate Lip 7, with the greatest arc of curvature being located at a point approximately half between the forward end of said base and the termination of said channel at said Tip 8, following which the bottom line curves upward to form a smooth junction with said tip 8 as seen in the prior embodiment at 7 FIG. 2. Said safety strap 10 is seen depending from said strap attachment 16 at the forward topmost end of said Base 3.

It will be apparent from the foregoing description that the invention presents an improved means for throwing and catching a ball 4, the means being characterized by a number of novel features. Due to simplicity of its construction, the device 1 of the present invention may be manufactured readily and inexpensively in large volume.

Although the invention has been shown and described with respect to preferred embodiments thereof, it should be understood by those skilled in the art that various changes and omissions in the form and detail thereof may be made therein without departing from the spirit and scope of the invention as defined in the appended claims.

I claim:

1. A ball game device for hurling and catching a ball comprising a modification of a hollow, elongate capsular shaped object having a base end wherein the full capsular shape is in evidence, and a terminal body section continuing forward from its junction with said base as the bottom half only of a capsular shape otherwise of the same overall dimension as said base, with said body constituting approximately ⅔ of the total length of said device;

wherein the internal diameter of said base is slightly greater than the external diameter of said ball, and wherein the outer surface of said base is studded with a series of separate, circumferential, rounded top ridges and pierced on its top surface between the terminal most pair of said ridges by a slot for receiving a safety strap affixed at the forward most limit of the top of said base section and means for attaching said safety strap to said device as well as for fastening said safety strap around a player's wrist; said ridges of said base being covered by a non-slip material of one of various sorts and means for adhering same to said base;

as to the capsular wall thickness, said body of said device continues forward integrally from said base at the same wall thickness as said base other than that the wall thickness of said body is modified along its top most margin by the formation of a lip as a slightly widened and inward projecting top-plate ridge that creates a top opening of slightly narrower dimension than is created by the basic arc of the otherwise uniformly curved capsular walls of both said base and body sections of said device;

the internal surface of said body otherwise being smooth and continuous throughout its length and integral with the internal surface of said base section forming thus a continuous channel for said ball in said device; and wherein the top to bottom depth at the center point of said channel of said body section is equal to about ½ of the diameter of said cylindrical base section, and wherein, from a topmost and forward most termination, an upper portion of said base, when viewed from either side, presents a slightly arcuate forward and downward sweep as it is brought from said topmost point of the leading edge of said base down to join a right and a left posterior limit of said channel's said lip section.

2. The device of claim 1 wherein the inner diameter of the cylindrical lower portion of said base is from about ¼ inch (0.64 cm.) to about 1 inch (2.54 cm.) greater than the diameter of said ball.

3. The device of claim 2 wherein the diameter of said base varies from about 2" (5.1 cm) to 4" (10.2 cm).

4. The device of claim 1 wherein the length of said body section approximates 3 to 6 times the diameter of said ball.

5. The device of claim 4 wherein the overall length of said body section varies from 6" (15.2 cm) to 15" (38.1 cm).

6. The device of claim 1 wherein the long axis span of said base section is slightly greater than the diameter of said ball.

7. The strap attachment means of claim 1 for attachment of said strap to said base of said device comprising, a slot situated near the forward topmost point of said base, through which is threaded one section of a strap and buckle combination, with the other end of said attachment strap sewed to a cross wise oriented strap bearing velcro closure material arranged for affixing said strap to a player's wrist.

8. The device of claim 1 wherein, when viewed from above, said body section expands laterally in a graded manner from its junction with said base, becoming thereby progressively of a wider dimension than said base, staying wider for the length of said body section until said body section ends in an arcuate tip; and when viewed from the side, said body section presents an outward curving bottom outline relative to the straight line bottom line of said base section, said outward curving body line of said body section starting at said tip, first arcing away from and then returning to join the forward most bottom point of said base section of said device.

9. The device of claim 8 wherein a. the inner diameter of the cylindrical lower portion of said base is from about ¼ inch (0.64 cm.) to about 1 inch (2.54 cm.) greater than the diameter of said ball;

b. the long axis span of said base section is slightly greater than the diameter of said ball;

c. the length of said body section approximates 3 to 6 times the diameter of said ball d. the safety strap attachment means for attachment of said safety strap to said base of said device comprises, a slot situated near the forward topmost point of said base, through which is threaded one section of a strap and buckle combination, with the other end of said safety strap sewed to a cross wise oriented strap bearing velcro closure material arranged for affixing said strap to a player's wrist.

10. A process for hurling and catching a ball by using the device of this invention by a. positioning said ball inside the deepest portion of the well of said base of said device b. with said base of said device being held directly in a player's hand and held in a substantially horizontal position but with the terminal portion of said device slightly inclined upwardly and forwardly to prevent said ball from rolling out inadvertently;

c. following which said ball is ejected from said device by a rapid swinging type motion of said player's arm that sends said ball down the length of an internal channel of said body of said device d. following which said ball exits along a trajectory primarily dictated by the scoop shaped, semi-closed termination of said channel;

e. said channel in said body of said device, with said device still hand held as described prior, being used by a player to catch said ball as part of an ongoing throwing and catching process performed by one or more players as said ball bounces off a wall or the floor of the enclosure in which the ball game is being played.

* * * * *